US010631091B1

(12) United States Patent
Beckett et al.

(10) Patent No.: US 10,631,091 B1
(45) Date of Patent: Apr. 21, 2020

(54) BENDING ACTUATORS AND PANEL AUDIO LOUDSPEAKERS INCLUDING THE SAME

(71) Applicant: Google LLC, Mountain View, CA (US)

(72) Inventors: Edward Beckett, Sunnyvale, CA (US); Mark William Starnes, Sunnyvale, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/289,567

(22) Filed: Feb. 28, 2019

(51) Int. Cl.

| | |
|---|---|
| ***H04R 9/06*** | (2006.01) |
| ***H04R 7/04*** | (2006.01) |
| ***H04R 9/02*** | (2006.01) |
| ***H04R 11/02*** | (2006.01) |

(52) U.S. Cl.
CPC ..... *H04R 7/045* (2013.01); *H04R 7/04* (2013.01); *H04R 9/025* (2013.01); *H04R 9/06* (2013.01); *H04R 11/02* (2013.01); *H04R 2440/05* (2013.01); *H04R 2499/11* (2013.01); *H04R 2499/15* (2013.01)

(58) Field of Classification Search
CPC ..... H04R 7/04; H04R 7/045; H04R 9/025; H04R 9/06; H04R 11/02; H04R 2440/01; H04R 2440/05; H04R 2499/11; H04R 2499/15
USPC ..... 381/152, 306, 333, 388, 398, 418, 423, 381/431
See application file for complete search history.

(56) References Cited

U.S. PATENT DOCUMENTS

| | | | | |
|---|---|---|---|---|
| 1,490,702 A | | 4/1924 | Koester | |
| 3,247,925 A | * | 4/1966 | Warnaka | H04R 7/10 381/398 |
| 4,272,654 A | * | 6/1981 | Carlson | H04R 11/00 29/594 |
| 7,174,025 B2 | * | 2/2007 | Azima | H04R 7/045 381/152 |

(Continued)

FOREIGN PATENT DOCUMENTS

| | | |
|---|---|---|
| FR | 653677 A | 3/1929 |
| GB | 191309904 A | 4/1914 |
| WO | WO 2007/028980 | 3/2007 |

OTHER PUBLICATIONS

PCT International Search Report and Written Opinion in International Appln No. PCT/US2019/061223, dated Feb. 5, 2020, 12 pages.

*Primary Examiner* — Huyen D Le
(74) *Attorney, Agent, or Firm* — Fish & Richardson P.C.

(57) ABSTRACT

A distributed mode loudspeaker (DML) includes a flat panel extending in a panel plane. The DML also includes a rigid, elongate member displaced from the flat panel and extending parallel to the panel plane, the elongate member being mechanically coupled to the flat panel at a first position along the elongate member and extending away from the first position to an end of the member free to vibrate in a direction perpendicular to the plane. The elongate member includes a soft magnetic material. The DML also includes an electromagnet system including at least one electrically-conducting coil having an axis perpendicular to the panel plane and displaced from the elongate member. The DML further includes an electronic control module electrically coupled to the electromagnet system and programmed to energize the electrically-conducting coil sufficient such that (Continued)

a magnetic field produced by the electrically-conducting coil displaces the free end of the elongate member.

20 Claims, 5 Drawing Sheets

(56) References Cited

U.S. PATENT DOCUMENTS 7,391,879 B2 * 6/2008 Beer ..... H04R 1/24
381/423
8,139,814 B2 3/2012 Rottenberg et al.

* cited by examiner

BENDING ACTUATORS AND PANEL AUDIO LOUDSPEAKERS INCLUDING THE SAME

BACKGROUND

Many conventional loudspeakers produce sound by inducing piston-like motion in a diaphragm. Panel audio loudspeakers, such as distributed mode loudspeakers (DMLs), in contrast, operate by inducing uniformly distributed vibration modes in a panel through an electro-acoustic actuator. Typically, the actuators are electromagnetic or piezoelectric actuators.

Conventional piezoelectric actuators often include toxic materials such as lead, while conventional EM actuators can include, pre-magnetized materials such as iron or neodymium, which can be heavy, brittle, and/or difficult to manufacture. In addition, pre-magnetized materials may become inoperable when heated above their Curie temperatures, therefore causing a conventional piezoelectric actuator that includes the pre-magnetized materials to stop operating.

SUMMARY

Actuators are disclosed that include a rigid, elongate member (e.g., a beam or plate) of soft magnetic material that demonstrates bending modes in response to actuation by an electromagnet or electromagnets positioned close to, but displaced from, the member. In some embodiments, an elongate member is attached to a panel by a stub and has a free end that can vibrate. A pair of electromagnets are positioned on opposing sides of the member and, when the electromagnets are activated, they generate a magnetic field that causes the member to bend. In the absence of a magnetic field, a restoring force generated by the deflection of the member returns the member to its resting state. Various vibration modes can be activated in the member by suitably cycling current through the opposing electromagnets, and these vibrations are transferred to the plate via the stub.

In general, in a first aspect, the invention features a distributed mode loudspeaker that includes a flat panel extending in a panel plane. The distributed mode loudspeaker also includes a rigid, elongate member displaced from the flat panel and extending parallel to the panel plane, the elongate member being mechanically coupled to the flat panel at a first position along the elongate member and extending away from the first position to an end of the member free to vibrate in a direction perpendicular to the plane. The elongate member includes a soft magnetic material. The distributed mode loudspeaker also includes an electromagnet system including at least one electrically-conducting coil having an axis perpendicular to the panel plane and displaced from the elongate member. The distributed mode loudspeaker further includes an electronic control module electrically coupled to the electromagnet system and programmed to energize the electrically-conducting coil sufficient such that a magnetic field produced by the electrically-conducting coil displaces the free end of the elongate member perpendicular to the panel plane.

Implementations of the distributed mode loudspeaker can include one or more of the following features and/or one or more features of other aspects. For example, the electronic control module can be programmed to energize the electrically-conducting coil to vibrate the elongate member at frequencies and amplitudes sufficient to produce an audio response from the flat panel.

In some implementations, the electrically-conducting coil is a first electrically-conducting coil and the electromagnet system further includes a second electrically-conducting coil having a corresponding axis perpendicular to the panel plane, the first and second electrically-conducting coils being on opposing sides of the elongate member. The first and second electrically-conducting coils can be aligned along a common axis. The electronic control module can be programmed to simultaneously energize the first and second electrically-conducting coils to vibrate the elongate member.

In some implementations, the member is mechanically coupled to the flat panel by a rigid element that displaces the member from the face of the flat panel.

In other implementations, the distributed mode loudspeaker also includes a rigid frame and the electrically-conducting coil is mechanically coupled to the rigid frame. The rigid frame can mechanically ground the electrically-conducting coil.

In some implementations, the electrically-conducting coil is arranged between the flat panel and the elongate member. In other implementations, the elongate member is arranged between the electrically-conducting coil and the flat panel.

In some implementations, the flat panel includes a flat panel display.

In yet other implementations, the electrically-conducting coil is a first coil and the electromagnet system further includes a second electrically-conducting coil arranged on a common side of the elongate member as the first coil.

In some implementations, the end of the elongate member free to vibrate is a first end and the elongate member extends away from the first position to a second end of the member free to vibrate in a direction perpendicular to the plane, the second end being opposite the first end. The first coil can be arranged between the first position and the first end and the second coil can be arranged between the first position and the second end.

In some implementations, the elongate member has a dimension in a range from about 10 mm to about 50 mm and a thickness of 3 mm or less. In some implementations, the elongate member has a stiffness and dimensions so that the distributed mode loudspeaker has a resonance frequency in a range from about 200 Hz to about 500 Hz.

In another aspect, a mobile device or a wearable device includes a housing and a display panel mounted in the housing. The mobile device or wearable device also includes a flat panel extending in a panel plane. The mobile device or wearable device further includes a rigid, elongate member displaced from the flat panel and extending parallel to the panel plane, the elongate member being mechanically coupled to the flat panel at a first position along the elongate member and extending away from the first position to an end of the member free to vibrate in a direction perpendicular to the plane. The elongate member can include a soft magnetic material. The mobile device or wearable device also includes an electromagnet system including at least one electrically-conducting coil having an axis perpendicular to the panel plane and displaced from the elongate member. The mobile device or wearable device further includes an electronic control module electrically coupled to the electromagnet system and programmed to energize the electrically-conducting coil sufficient such that a magnetic field produced by the electrically-conducting coil displaces the free end of the elongate member perpendicular to the panel plane.

In some implementations the mobile device is a mobile phone or a tablet computer. In some implementations, the wearable device is a smart watch or a head-mounted display.

Among other advantages, embodiments feature electromagnet (EM) actuators having few moving parts. For example, EM actuators can include only a single moving part corresponding to the elongate member. Such actuators may be less susceptible to damage than, for example, conventional EM actuators. In particular, such actuators may be less susceptible to damage due to mechanical impact, e.g., from being dropped, than conventional EM actuators. Another advantage provided by the disclosed EM actuators is that they can be smaller and lighter than those that include permanent magnets. Additionally, the disclosed DMLs can be manufactured without the use of toxic materials such as lead. Another advantage provided by the disclosed EM actuators is that they can operate above the Curie temperatures of certain magnets and piezoelectric devices. Therefore, the disclosed EM actuators can be used as high-temperature actuators, e.g., ones that operate in extreme environments.

Other advantages will be evident from the description, drawings, and claims.

BRIEF DESCRIPTION OF THE DRAWINGS

Like reference symbols in the various drawings indicate like elements.

DETAILED DESCRIPTION

Figure 1:
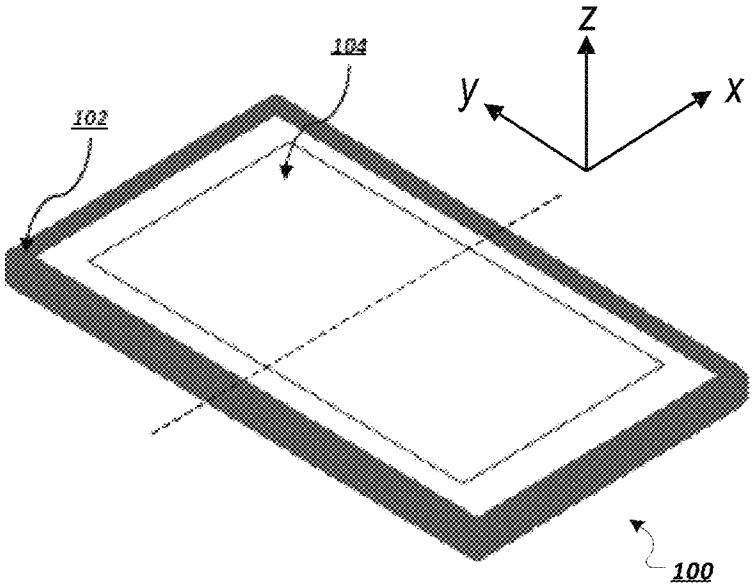
FIG. 1 is a perspective view of an embodiment of a mobile device.

The disclosure features actuators for panel audio loudspeakers, such as distributed mode loudspeakers (DMLs). Such loudspeakers can be integrated into a mobile device, such as a mobile phone. For example, referring to FIG. 1, a mobile device 100 includes a device chassis 102 and a touch panel display 104 including a flat panel display (e.g., an OLED or LCD display panel) that integrates a panel audio loudspeaker. FIG. 1 also includes a Cartesian coordinate system with x, y, and z axes, for ease of reference. Mobile device 100 interfaces with a user in a variety of ways, including by displaying images and receiving touch input via touch panel display 104. Typically, a mobile device has a depth (in the z-direction) of approximately 10 mm or less, a width (in the x-direction) of 60 mm to 80 mm (e.g., 68 mm to 72 mm), and a height (in the y-direction) of 100 mm to 160 mm (e.g., 138 mm to 144 mm).

Mobile device 100 also produces audio output. The audio output is generated using a panel audio loudspeaker that creates sound by causing the flat panel display to vibrate. The display panel is coupled to an actuator, such as a distributed mode actuator, or DMA. The actuator is a movable component arranged to provide a force to a panel, such as touch panel display 104, causing the panel to vibrate. The vibrating panel generates human-audible sound waves, e.g., in the range of 20 Hz to 20 kHz.

In addition to producing sound output, mobile device 100 can also produces haptic output using the actuator. For example, the haptic output can correspond to vibrations in the range of 180 Hz to 300 Hz.

Figure 2:
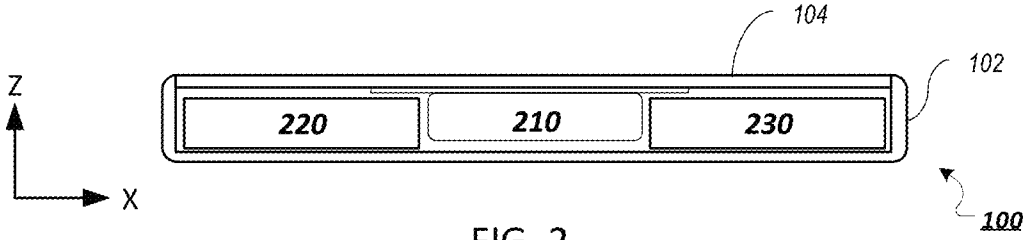
FIG. 2 is a schematic cross-sectional view of the mobile device of FIG. 1.

FIG. 1 also shows a dashed line that corresponds to the cross-sectional direction shown in FIG. 2. Referring to FIG. 2, a cross-section of mobile device 100 illustrates device chassis 102 and touch panel display 104. Device chassis 102 has a depth measured along the z-direction and a width measured along the x-direction. Device chassis 102 also has a back panel, which is formed by the portion of device chassis 102 that extends primarily in the xy-plane. Mobile device 100 includes an actuator 210, which is housed behind display 104 in chassis 102 and affixed to the back side of display 104. Generally, actuator 210 is sized to fit within a volume constrained by other components housed in the chassis, including an electronic control module 220 and a battery 230.

Figure 3:
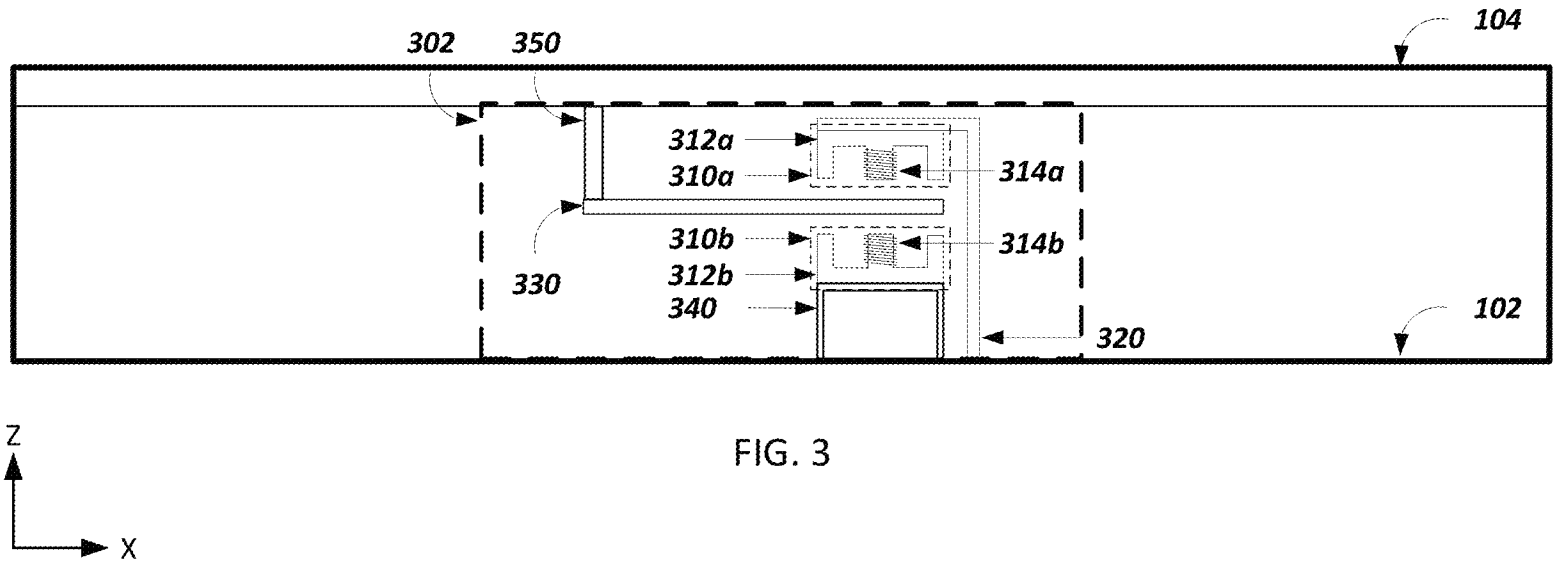
FIG. 3 is a cross-section of a mobile device that features an electromagnet actuator 302 that includes a single pair of electromagnets.

Referring to FIG. 3, a mobile device 300, shown in cross-section, features an electromagnet actuator 302, which includes a pair of electromagnet assemblies 310*a* and 310*b* that are outlined in dashed lines. Electromagnet assemblies 310*a* and 310*b* are positioned on opposing sides of an elongate member 330. Member 330 is attached to panel 104 by a stub 350. The member is attached to stub 350 at one end, while the opposite end is free to vibrate. The electromagnet assemblies are positioned on opposing sides of elongate member 330 proximate to the free end of the member. Electromagnet assembly 310*a* is attached to a frame 320, which is attached at one end to chassis 102. Frame 320 suspends electromagnet assembly 310*a* above member 330. Below member 330, electromagnet assembly 310*b* is attached to a spacer 340, which ensures that electromagnets assemblies 310*a* and 310*b* are spaced approximately the same distance from member 330, as measured in the z-direction.

Electromagnet assemblies 310*a* and 310*b* each includes a corresponding support structure 312*a* and 312*b* that includes a central pole, which support conductive coils 314*a* and 314*b*, respectively. Coils 314*a* and 314*b* are axially aligned parallel to the z-axis.

Magnetic assemblies 310*a* and 310*b* can be relatively compact. For example, the width of the central pole can be approximately 3 mm to 8 mm when measured in the x-direction, while the width of the surrounding wall of the support structure can be approximately half the width of the central pole, when measured in the x-direction. The height of electromagnet assemblies 310*a* and 310*b* can be approximately 1 mm to 3 mm, e.g., 2 mm.

Generally, elongate member 330 has a dimension in the xy-plane that is significantly larger than its thickness (i.e., in the z-direction). For example, member 330 can be shaped as a beam (e.g., where the dimension along the x-direction is significantly larger than the y-dimension and the thickness) or a plate (e.g., where the x- and y-dimensions are comparable, and both are significantly larger than the thickness). The dimension in the x-dimension, for example, can be about 10 mm to about 50 mm (e.g., about 12 mm to about 20 mm) and the thickness can be about 3 mm or less (e.g., 2 mm or less, 1 mm or less, 0.5 mm less).

The material composition of member 330 are chosen such that the member can be magnetized, i.e., by magnetic fields generated by electromagnet assemblies 310*a* and 310*b*. Member 330 should also be sufficiently rigid to support vibrational modes introduced by displacements at the free end of the member. Member 330 can include a soft magnetic material. Examples of soft magnetic materials include certain alloys, such as nickel-iron alloys (permalloy), and soft ferrites (e.g., ferroxcube). In some embodiments, member 330 is made of steel, e.g., 1018 steel.

In general, the placement of the electromagnet assemblies relative to the elongate member are chosen based on a number of considerations, including the amount of space available for the actuator within the chassis and the mechanical impedance of the elongate member. In some embodiments, so as to match the mechanical impedance of the resonant member to that of panel 104. In certain cases, the closer the electromagnets are to stub 350, the higher the mechanical impedance that beam 330 presents to the electromagnet system.

During the operation of actuator 302, electronic control module 220 energizes one of coils 314*a* and 314*b* by applying an AC current to each. In response, each coil generates a magnetic field that interacts with member 330, causing the free end of the member to vibrate. Generally, the frequency, amplitude, and relative phase of the AC currents supplied to the two coils are controlled to generate a desired frequency response in the member, and by the coupling of the member to the panel via the stub, the desired audio output of the panel. In some embodiments, coils 314*a* and 314*b* are driven with AC current having the same frequency but approximately 180° out of phase. When coils 314*a* and 314*b* are no longer energized, member 330 returns to a rest position, as shown in FIG. 3.

Periodically energizing coils 314*a* and 314*b* can cause actuator 302 to excite various vibrational modes in panel 104, including resonant modes. For example, the touch panel display can have a fundamental resonance frequency in a range from about 200 Hz to about 600 Hz (e.g., at about 500 Hz), and one or more additional higher order resonance frequencies in a range from about 5 kHz to about 20 kHz.

Generally, while FIG. 3 shows one configuration of an actuator, variants are possible. For example, while actuator 302 includes spacer 340, the spacer can be omitted, e.g., when member 330 is positioned in the z-direction such that electromagnet assemblies 310*a* and 310*b* are equidistant from the member.

Figure 4:
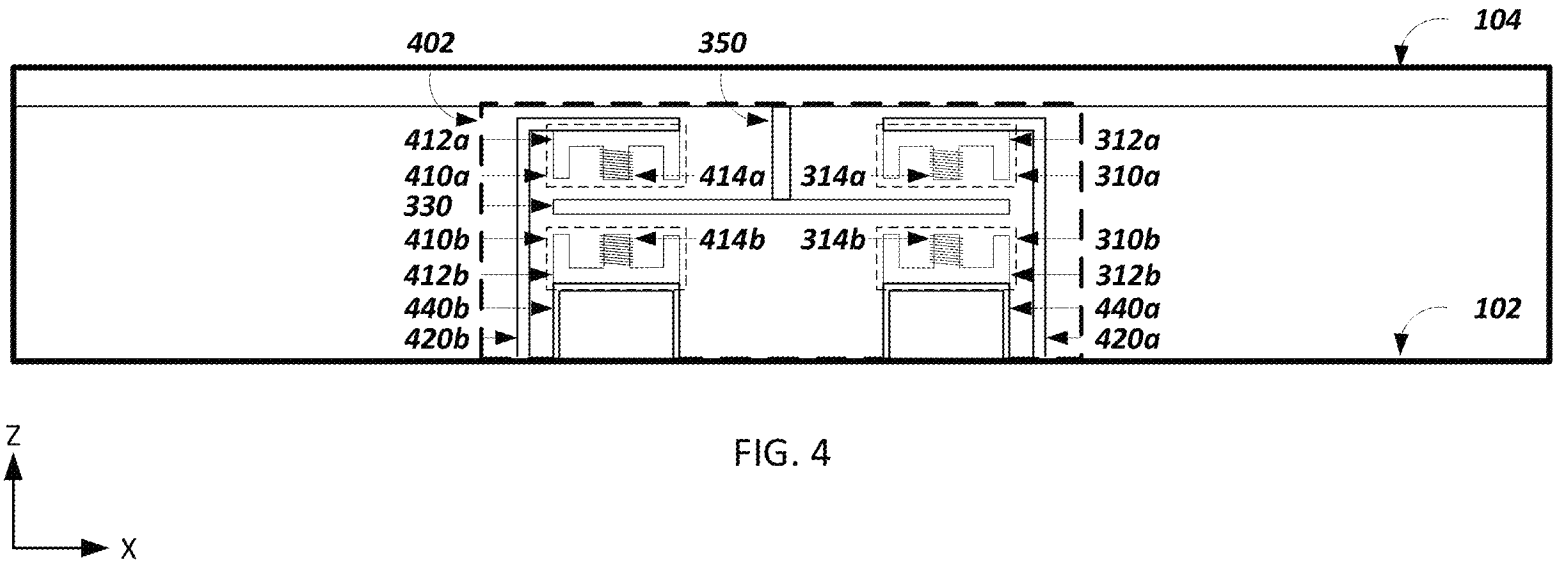
FIG. 4 is a cross-section of a mobile device that features an electromagnet actuator that includes two pairs of electromagnets.

Furthermore, while FIG. 3 shows an implementation of an actuator 302 that has a member that is fixed at one end while the other is free to vibrate and includes a single pair of electromagnet assemblies to activate the free end, other configurations are possible. For example, embodiments can include more than one pair of electromagnet assemblies For example, FIG. 4 shows a mobile device 400 in cross-section including an actuator 402, which includes electromagnet assemblies 310*a* and 310*b* and electromagnet assemblies 410*a* and 410*b*. Actuator 402 includes a member 330 and a stub 350 that attaches member 330 approximately half-way between two opposite ends of the member.

Actuator 402 also includes a pair of frames 420*a* and 420*b* that support electromagnet assemblies 310*a* and 410*a*, respectively. Spacers 440*a* and 440*b* support electromagnet assemblies 310*b* and 410*b*. Electromagnet assemblies 310*a* and 310*b* are positioned on opposing sides of member 330 at one free end of the member, while assemblies 410*a* and 410*b* are positioned on opposing sides at the other free end of member 330. Like assemblies 310*a* and 310*b*, assembly 410*a* includes a support structure 412*a* and a coil 414*a*, while assembly 410*b* includes a support structure 412*b* and a coil 414*b*.

Just as electronic control module 220 drives actuator 302 such that only a subset, e.g., one of the two electromagnet assemblies 310*a* and 310*b*, is activated at a time, the electronic control module can drive actuator 402 such that only a subset of electromagnets 310*a*, 310*b*, 410*a*, and 410*b* are activated at a time. For example, electronic control module 220 can periodically activate one of the four electromagnets at a time and cycle through each of the four electromagnets. As another example, electronic control module 220 can periodically activate two of the four electromagnets at a time and cycle through two of the four electromagnets, e.g., such that electromagnets 310*a* and 410*a* are activated for part of the cycle, while electromagnets 310*b* and 410*b* are activated for the remaining part of the cycle.

While FIG. 3 shows an actuator that includes a pair of electromagnets, a single electromagnet can be used. When a single electromagnet is used, the material properties of member 330 is chosen such that the member returns to its rest position, as shown in FIG. 3, when the electromagnet is not activated. In implementations that include a single electromagnet, an AC signal used to drive the electromagnet can be offset in voltage such that a minima of the waveform corresponds to the rest position of member 330. That is, the driving signal is biased so that it oscillates about an offset voltage, instead of, for example, zero volts. In this implementation, the driving signal can be processed to remove distortion components that occur as a result of a varying force on member 330 as the member changes position relative to the electromagnet.

In some embodiments, actuators can include multiple electromagnetic assembly pairs arrayed in two dimensions. For example, referring to FIG. 5, an actuator 502 includes an upper frame 504, a lower frame 506, and an elongate member 530 positioned between the upper and lower frames. Elongate member 530 is in the form of a plate, extending in both the x and y-directions. Upper and lower frames 504 and 506 are supported by struts 510, which attach at one end to corners of the upper frame and at an opposite end to device chassis 102. Between their attachments to upper frame 504 and the device chassis or other component within the mobile device, each strut 510 is also attached to lower frame 506. Upper frame 504 includes an aperture 508, through which stub 350 passes. At one end, stub 350 is attached to panel 104, while at an opposite end, the stub is attached to member 530.

Upper and lower frames 504 and 506 both include multiple electromagnet assemblies (examples are labeled 310*a* and 310*b*, respectively). In particular, each frame includes eight electromagnet assemblies arrayed in a three by three grid (except for the central grid position, where aperture 508 located).

During operation, member 530 vibrates in response to a periodic activation of the electromagnet assemblies of upper frame 504 and lower frame 506. The force of the vibration is transferred to panel 104 by stub 350, causing panel 104 to vibrate and produce sound waves. Electronic control module 220 can selectively activate one or more of the electromagnets of upper frame 504 and lower frame 506. The arrangement of the electromagnetic assemblies in a two-dimensional array facilitates two-dimensional vibrational modes in member 530.

Figure 5:
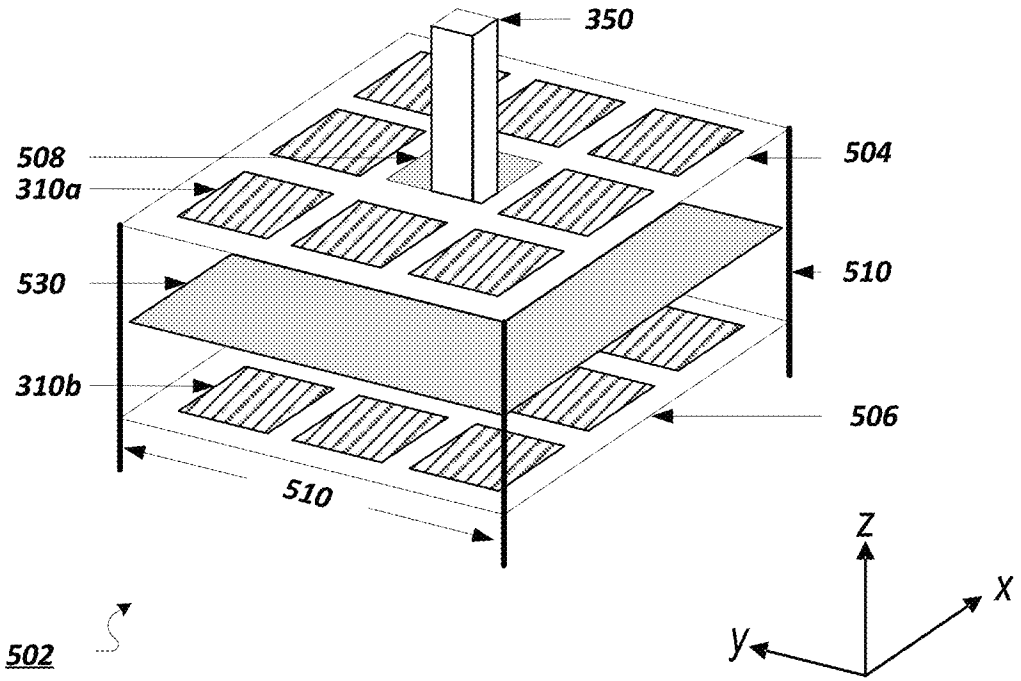
FIG. 5 is a cross-section of a mobile device that features an electromagnet actuator that includes eight pairs of electromagnets.

While FIG. 5 shows a configuration that includes eight electromagnets, other configurations, having more or less electromagnets than those shown in FIG. 5 are possible.

Figure 6:
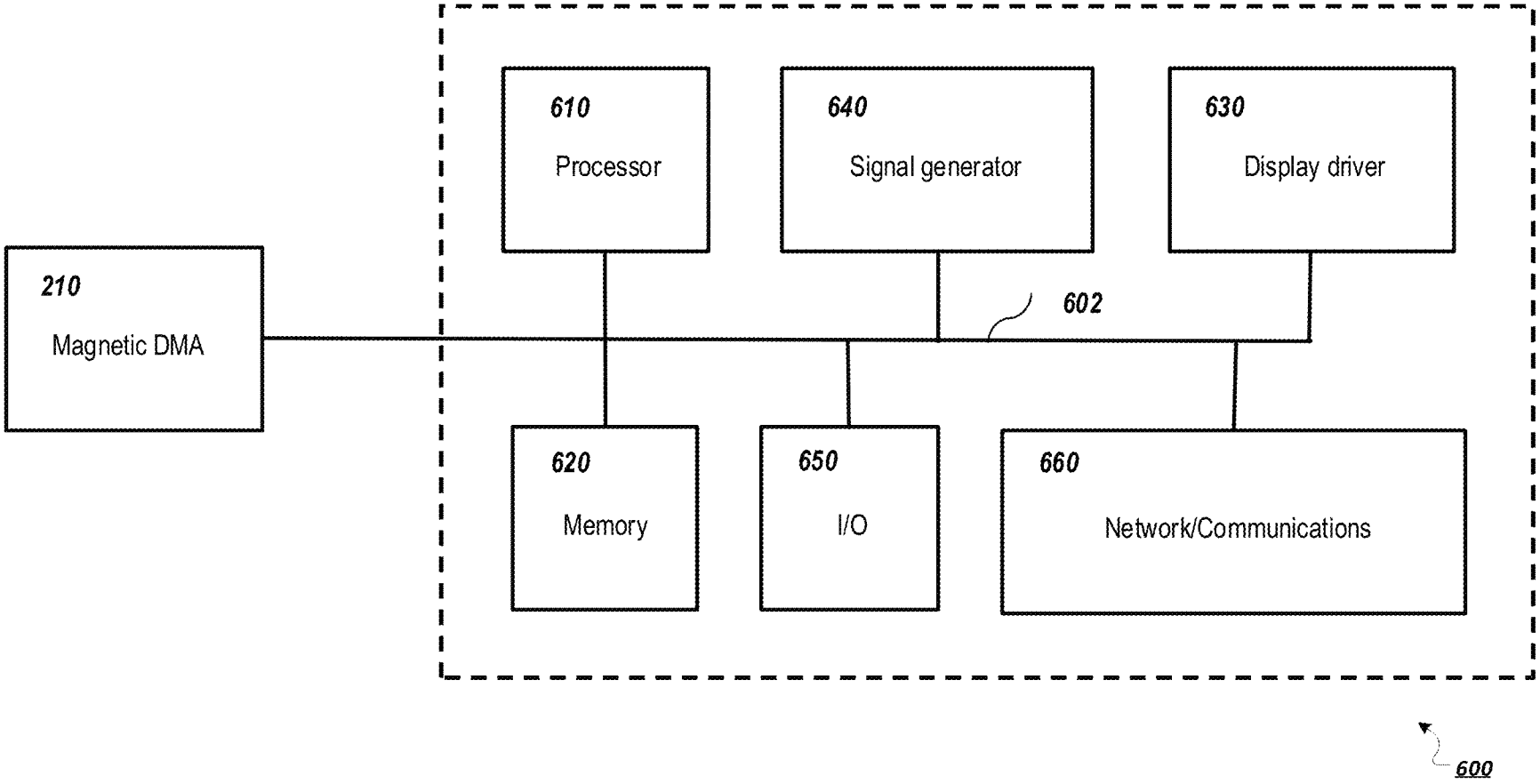
FIG. 6 is a schematic diagram of an embodiment of an electronic control module for a mobile device.

In general, the actuators described above are controlled by an electronic control module, e.g., electronic control module 220 in FIG. 2 above. In general, electronic control modules are composed of one or more electronic components that receive input from one or more sensors and/or signal receivers of the mobile phone, process the input, and generate and deliver signal waveforms that cause actuator 210 to provide a suitable haptic response. Referring to FIG. 6, an exemplary electronic control module 600 of a mobile device, such as mobile device 100, includes a processor 610, memory 620, a display driver 630, a signal generator 640, an input/output (I/O) module 650, and a network/communications module 660. These components are in electrical communication with one another (e.g., via a signal bus 602) and with actuator 210.

Processor 610 may be implemented as any electronic device capable of processing, receiving, or transmitting data or instructions. For example, processor 610 can be a microprocessor, a central processing unit (CPU), an application-specific integrated circuit (ASIC), a digital signal processor (DSP), or combinations of such devices.

Memory 620 has various instructions, computer programs or other data stored thereon. The instructions or computer programs may be configured to perform one or more of the operations or functions described with respect to the mobile device. For example, the instructions may be configured to control or coordinate the operation of the device's display via display driver 630, signal generator 640, one or more components of I/O module 650, one or more communication channels accessible via network/communications module 660, one or more sensors (e.g., biometric sensors, temperature sensors, accelerometers, optical sensors, barometric sensors, moisture sensors and so on), and/or actuator 210.

Signal generator 640 is configured to produce AC waveforms of varying amplitudes, frequency, and/or pulse profiles suitable for actuator 210 and producing acoustic and/or haptic responses via the actuator. Although depicted as a separate component, in some embodiments, signal generator 640 can be part of processor 610. In some embodiments, signal generator 640 can include an amplifier, e.g., as an integral or separate component thereof.

Memory 620 can store electronic data that can be used by the mobile device. For example, memory 620 can store electrical data or content such as, for example, audio and video files, documents and applications, device settings and user preferences, timing and control signals or data for the various modules, data structures or databases, and so on. Memory 620 may also store instructions for recreating the various types of waveforms that may be used by signal generator 640 to generate signals for actuator 210. Memory 620 may be any type of memory such as, for example, random access memory, read-only memory, Flash memory, removable memory, or other types of storage elements, or combinations of such devices.

As briefly discussed above, electronic control module 600 may include various input and output components represented in FIG. 6 as I/O module 650. Although the components of I/O module 650 are represented as a single item in FIG. 6, the mobile device may include a number of different input components, including buttons, microphones, switches, and dials for accepting user input. In some embodiments, the components of I/O module 650 may include one or more touch sensor and/or force sensors. For example, the mobile device's display may include one or more touch sensors and/or one or more force sensors that enable a user to provide input to the mobile device.

Each of the components of I/O module 650 may include specialized circuitry for generating signals or data. In some cases, the components may produce or provide feedback for application-specific input that corresponds to a prompt or user interface object presented on the display.

As noted above, network/communications module 660 includes one or more communication channels. These communication channels can include one or more wireless interfaces that provide communications between processor 610 and an external device or other electronic device. In general, the communication channels may be configured to transmit and receive data and/or signals that may be interpreted by instructions executed on processor 610. In some cases, the external device is part of an external communication network that is configured to exchange data with other devices. Generally, the wireless interface may include, without limitation, radio frequency, optical, acoustic, and/or magnetic signals and may be configured to operate over a wireless interface or protocol. Example wireless interfaces include radio frequency cellular interfaces, fiber optic interfaces, acoustic interfaces, Bluetooth interfaces, Near Field Communication interfaces, infrared interfaces, USB interfaces, Wi-Fi interfaces, TCP/IP interfaces, network communications interfaces, or any conventional communication interfaces.

In some implementations, one or more of the communication channels of network/communications module 660 may include a wireless communication channel between the mobile device and another device, such as another mobile phone, tablet, computer, or the like. In some cases, output, audio output, haptic output or visual display elements may be transmitted directly to the other device for output. For example, an audible alert or visual warning may be transmitted from the mobile device 100 to a mobile phone for output on that device and vice versa. Similarly, the network/communications module 660 may be configured to receive input provided on another device to control the mobile device. For example, an audible alert, visual notification, or haptic alert (or instructions therefore) may be transmitted from the external device to the mobile device for presentation.

The actuator technology disclosed herein can be used in panel audio systems, e.g., designed to provide acoustic and/or haptic feedback. The panel may be a display system, for example based on OLED of LCD technology. The panel may be part of a smartphone, tablet computer, or wearable devices (e.g., smartwatch or head-mounted device, such as smart glasses).

Other embodiments are in the following claims.

What is claimed is:

1. A distributed mode loudspeaker, comprising:

a flat panel extending in a panel plane;

a rigid, elongate member displaced from the flat panel and extending parallel to the panel plane, the elongate member being mechanically coupled to the flat panel at a first position along the elongate member and extending away from the first position to an end of the member free to vibrate in a direction perpendicular to the plane, wherein the elongate member comprises a soft magnetic material;

an electromagnet system comprising at least one electrically-conducting coil having an axis perpendicular to the panel plane and displaced from the elongate member; and an electronic control module electrically coupled to the electromagnetic system and programmed to energize the electrically-conducting coil sufficient such that a magnetic field produced by the electrically-conducting coil displaces the free end of the elongate member perpendicular to the panel plane.

2. The distributed mode loudspeaker of claim 1, wherein the electronic control module is programmed to energize the electrically-conducting coil to vibrate the elongate member at frequencies and amplitudes sufficient to produce an audio response from the flat panel.

3. The distributed mode loudspeaker of claim 1, wherein the electrically-conducting coil is a first electrically-conducting coil and the electromagnet system further comprises a second electrically-conducting coil having a corresponding axis perpendicular to the panel plane, the first and second electrically-conducting coils being on opposing sides of the elongate member.

4. The distributed mode loudspeaker of claim 3, wherein the first and second electrically-conducting coils are aligned along a common axis.

5. The distributed mode loudspeaker of claim 3, wherein the electronic control module is programmed to simultaneously energize the first and second electrically-conducting coils to vibrate the elongate member.

6. The distributed mode loudspeaker of claim 1, wherein the member is mechanically coupled to the flat panel by a rigid element that displaces the member from the face of the flat panel.

7. The distributed mode loudspeaker of claim 1, further comprising a rigid frame, the electrically-conducting coil being mechanically coupled to the rigid frame.

8. The distributed mode loudspeaker of claim 7, wherein the rigid frame mechanically grounds the electrically-conducting coil.

9. The distributed mode loudspeaker of claim 1, wherein the electrically-conducting coil is arranged between the flat panel and the elongate member.

10. The distributed mode loudspeaker of claim 1, wherein the elongate member is arranged between the electrically-conducting coil and the flat panel.

11. The distributed mode loudspeaker of claim 1, wherein the flat panel comprises a flat panel display.

12. The distributed mode loudspeaker of claim 1, wherein the electrically-conducting coil is a first coil and the electromagnet system further comprises a second electrically-conducting coil arranged on a common side of the elongate member as the first coil.

13. The distributed mode loudspeaker of claim 12, wherein end of the elongate member free to vibrate is a first end and the elongate member extends away from the first position to a second end of the member free to vibrate in a direction perpendicular to the plane, the second end being opposite the first end.

14. The distributed mode loudspeaker of claim 13, wherein the first coil is arranged between the first position and the first end and the second coil is arranged between the first position and the second end.

15. The distributed mode loudspeaker of claim 1, wherein the elongate member has a dimension in a range from about 10 mm to about 50 mm and a thickness of 3 mm or less.

16. The distributed mode loudspeaker of claim 1, wherein the elongate member has a stiffness and dimensions so that the distributed mode loudspeaker has a resonance frequency in a range from about 200 Hz to about 500 Hz.

17. A mobile device, comprising:

a housing;

a display panel mounted in the housing;

a flat panel extending in a panel plane;

a rigid, elongate member displaced from the flat panel and extending parallel to the panel plane, the elongate member being mechanically coupled to the flat panel at a first position along the elongate member and extending away from the first position to an end of the member free to vibrate in a direction perpendicular to the plane, wherein the elongate member comprises a soft magnetic material;

an electromagnet system comprising at least one electrically-conducting coil having an axis perpendicular to the panel plane and displaced from the elongate member; and an electronic control module electrically coupled to the electromagnetic system and programmed to energize the electrically-conducting coil sufficient such that a magnetic field produced by the electrically-conducting coil displaces the free end of the elongate member perpendicular to the panel plane.

18. The mobile device of claim 17, wherein the mobile device is a mobile phone or a tablet computer.

19. A wearable device comprising:

a housing;

a display panel mounted in the housing;

a flat panel extending in a panel plane;

a rigid, elongate member displaced from the flat panel and extending parallel to the panel plane, the elongate member being mechanically coupled to the flat panel at a first position along the elongate member and extending away from the first position to an end of the member free to vibrate in a direction perpendicular to the plane, wherein the elongate member comprises a soft magnetic material;

an electromagnet system comprising at least one electrically-conducting coil having an axis perpendicular to the panel plane and displaced from the elongate member; and an electronic control module electrically coupled to the electromagnetic system and programmed to energize the electrically-conducting coil sufficient such that a magnetic field produced by the electrically-conducting coil displaces the free end of the elongate member perpendicular to the panel plane.

20. The wearable device of claim 19, wherein the wearable device is a smart watch or a head-mounted display.

* * * * *